United States Patent [19]

Holt

[11] 3,968,555

[45] July 13, 1976

[54] ELECTRICALLY OPERATED PROGRAMMABLE INSERTION TOOL WITH CONDUCTOR GUIDE AND MOVABLE STRAIN RELIEF INSERTION MECHANISMS

[75] Inventor: Harley Raymond Holt, Forest Park, Ill.

[73] Assignee: Bunker Ramo Corporation, Oak Brook, Ill.

[22] Filed: Feb. 11, 1975

[21] Appl. No.: 548,903

Related U.S. Application Data

[63] Continuation-in-part of Ser. No. 500,633, Aug. 26, 1974, abandoned.

[52] U.S. Cl. ..... 29/203 MW; 29/203 DT; 29/628

[51] Int. Cl.[2] ..... H01R 43/04

[58] Field of Search. 29/203 MW, 203 DT, 203 HT, 29/203 P, 203 R, 203 H, 203 D, 628

[56] References Cited

UNITED STATES PATENTS

| | | | |
|---|---|---|---|
| 3,742,571 | 7/1973 | Brehm | 29/203 HT |
| 3,845,535 | 11/1974 | Over | 29/203 MW |

*Primary Examiner*—Carl E. Hall

*Attorney, Agent, or Firm*—William Lohff; F. M. Arbuckle

[57] ABSTRACT

Apparatus for inserting a plurality of insulated conductors in respective insulation piercing portions of contacts of an electrical device employs an electrically operable programmer for selectively controlling movement of a carriage along the electrical device, for example an electrical connector, and for controlling the insertion of conductors on each side of the device. The carriage is mounted for movement along the connector and is selectively programmed to stop at rest insertion positions at which insertion tools are operated to insert and terminate the conductors. The conductors are moved in the general direction of the insulation piercing portions of the contacts, manually and under tension, and are received by guide means which accurately align and position the conductors adjacent the respective contact portions. Each insertion tool includes two blades which are movable together toward the electrical connector. One of the blades normally extends beyond the other to slightly pre-insert a portion of a conductor into a strain relief member adjacent the contact portion prior to cutting and insertion of the conductor into the insulation piercing contact portion. The strain relief insertion blade is biased toward its extended position and movable with respect to the other insertion blade so as to have its forward end aligned with the forward end of the other blade for simultaneous and complete insertion of the conductor into the contact portion and the strain relief member after initial partial pre-insertion and cutting have occurred. Individual conductors of a pair of conductors may be simultaneously inserted on opposite sides of a connector, or sequentially on the same side of a connector by selection of double-sided or single-sided modes of operation. Also, connectors of different widths may be safely contacted without contact damage. A visual indicator is provided to indicate the position of a contact being terminated.

60 Claims, 17 Drawing Figures

Fig. 3
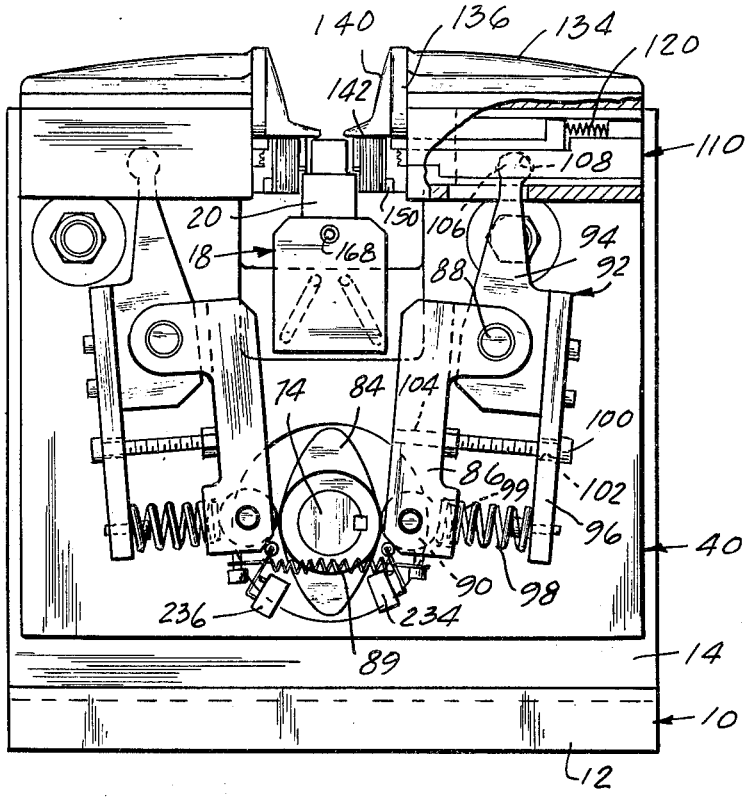
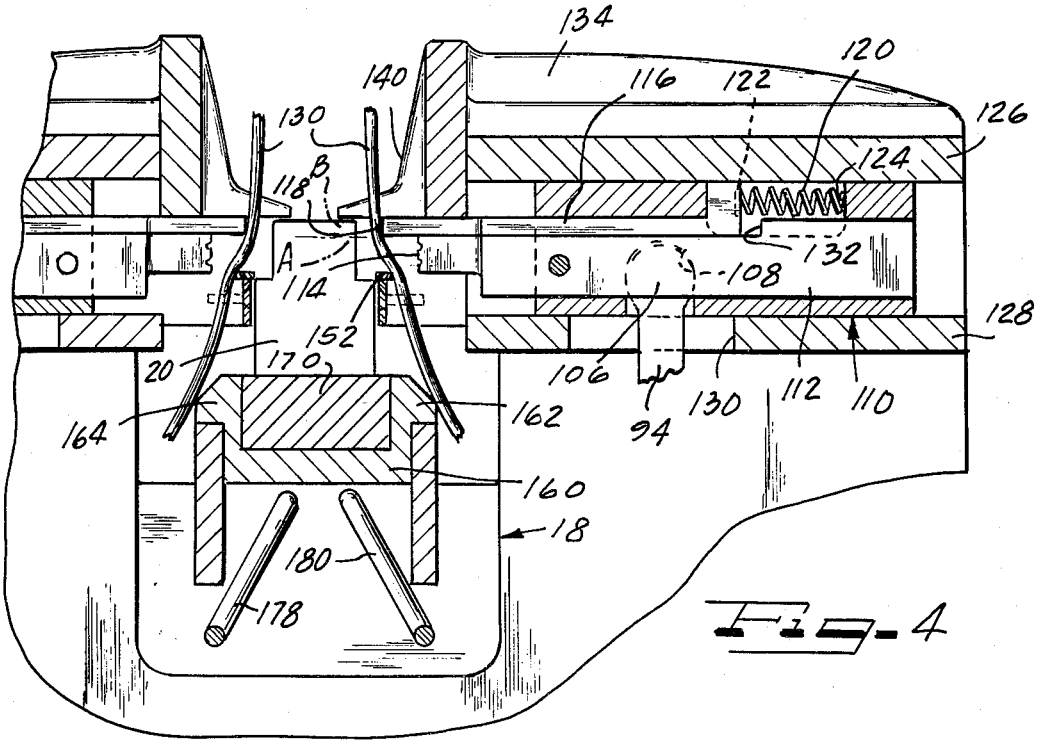
Fig. 4

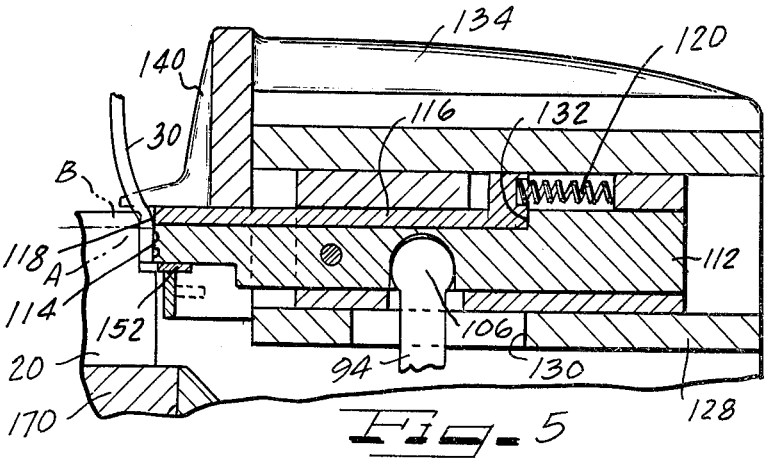
Fig. 5
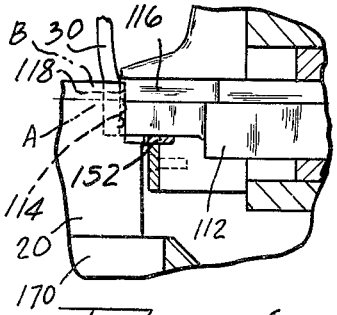
Fig. 6
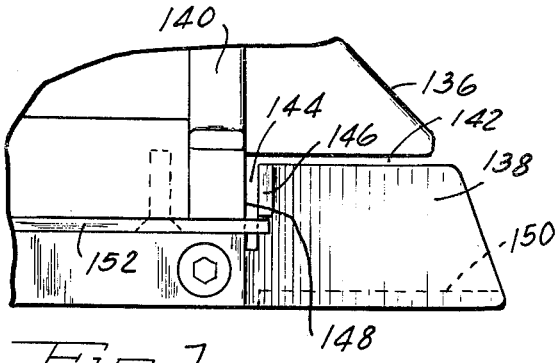
Fig. 7
Fig. 8
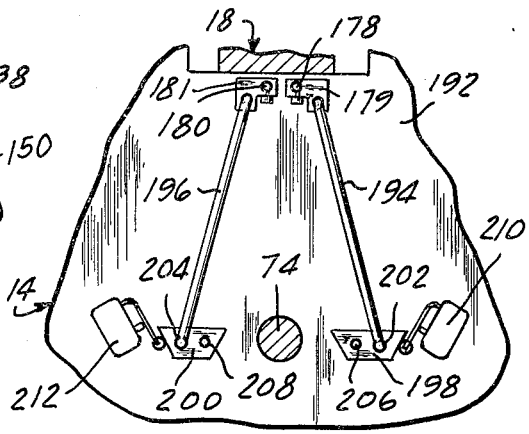
Fig. 9
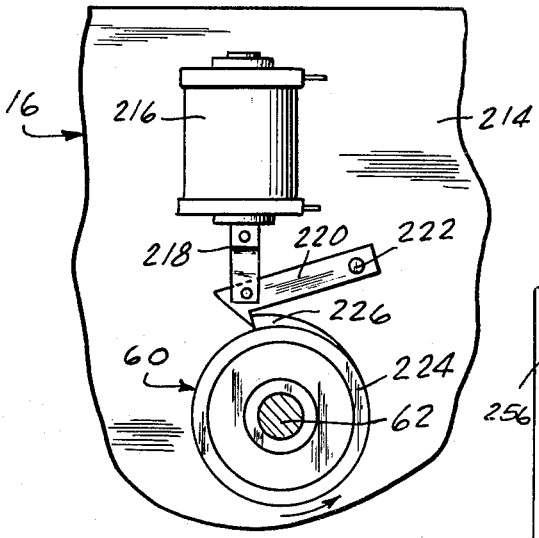
Fig. 10
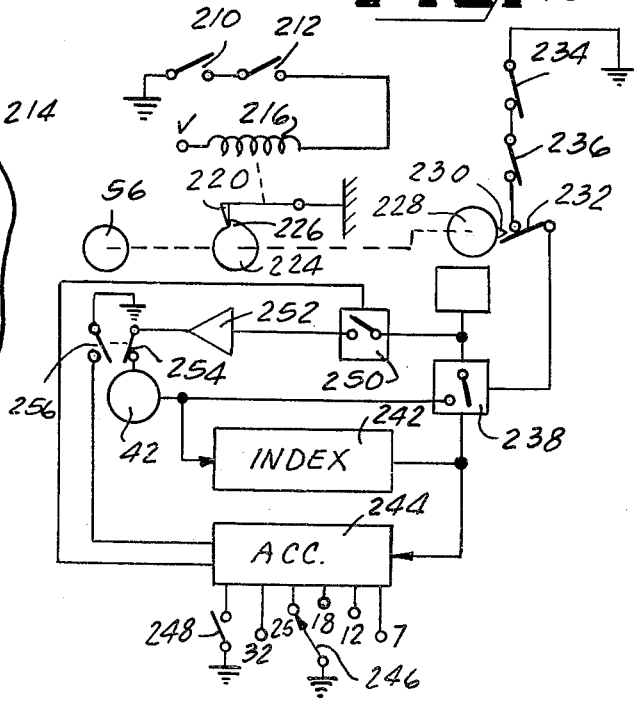

Fig. 11
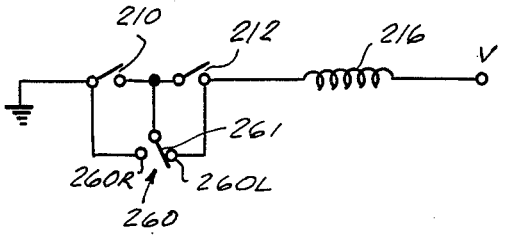
Fig. 12
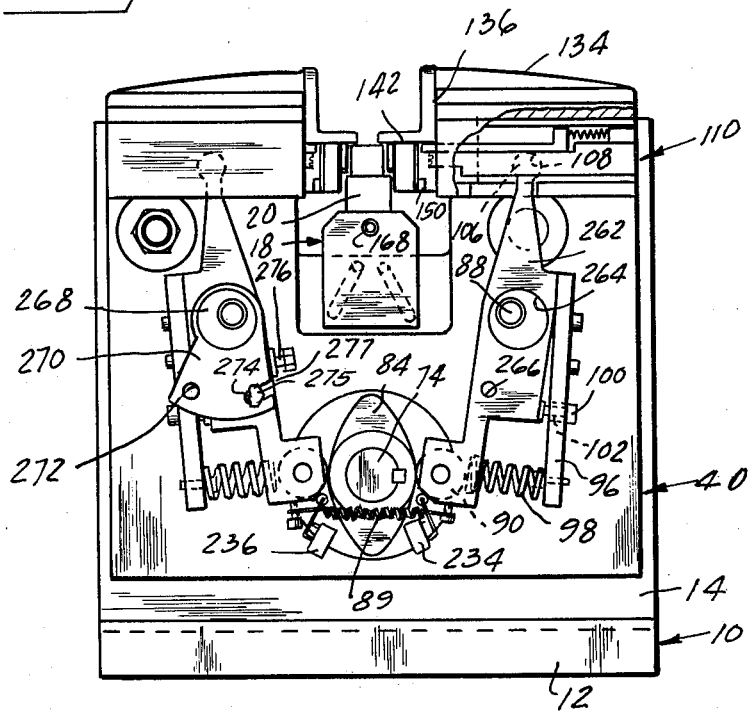
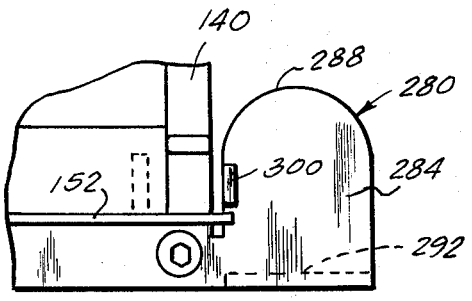
Fig. 13
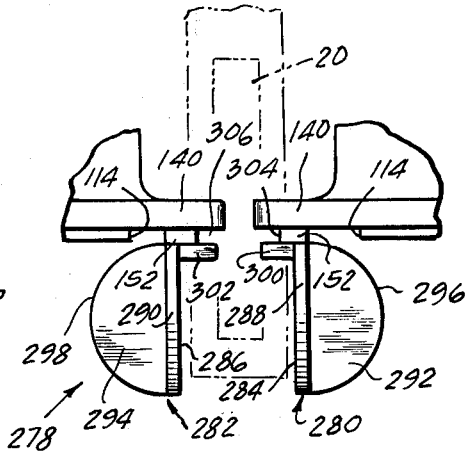
Fig. 14

Fig. 15
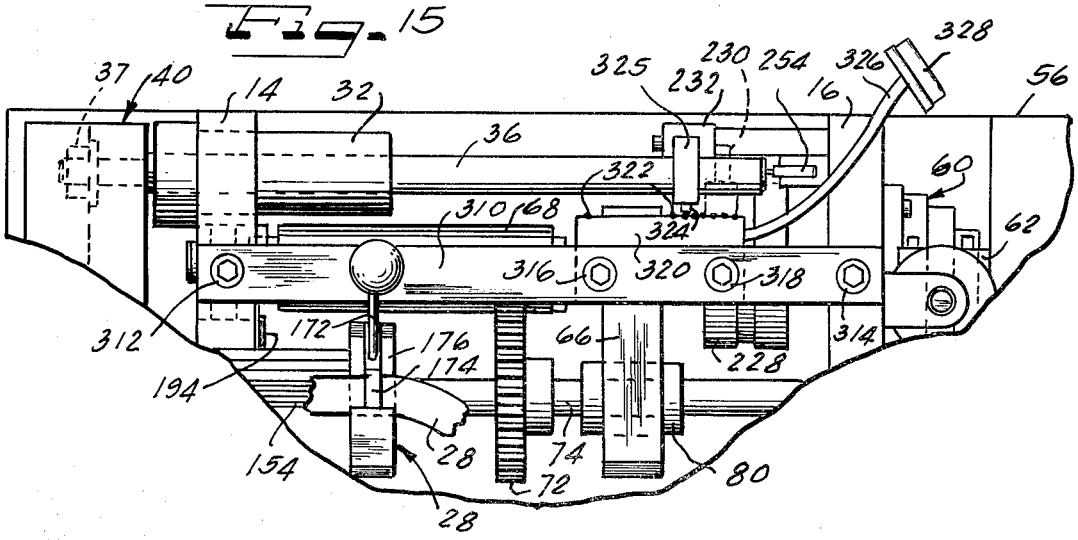
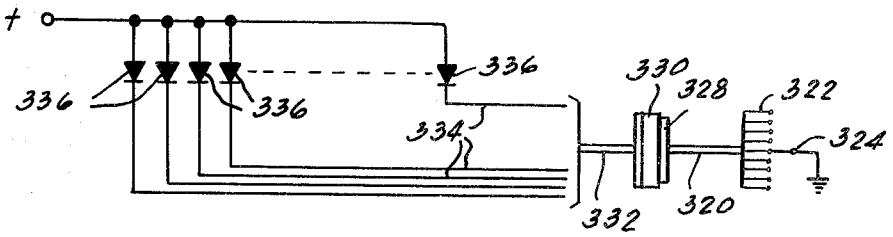
Fig. 16
Fig. 17
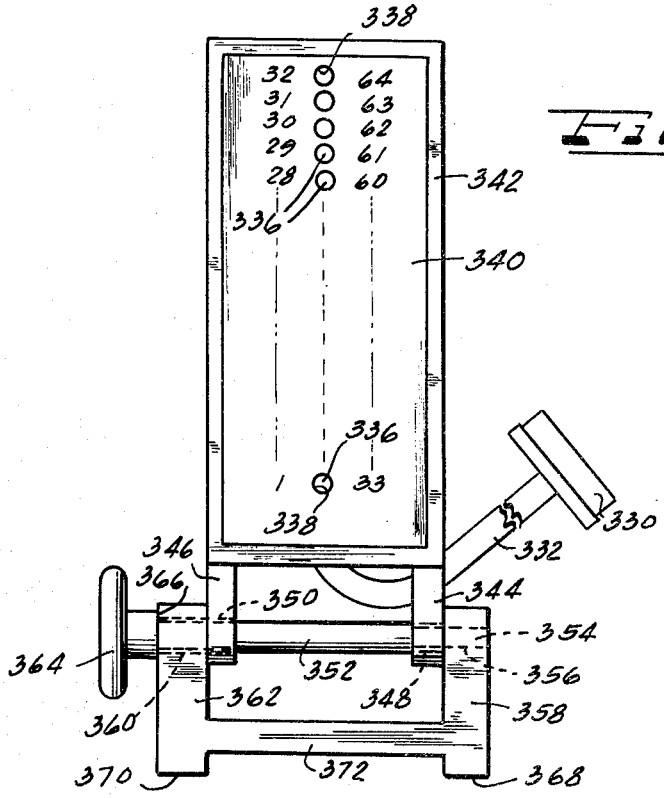

ELECTRICALLY OPERATED PROGRAMMABLE INSERTION TOOL WITH CONDUCTOR GUIDE AND MOVABLE STRAIN RELIEF INSERTION MECHANISMS

CROSS REFERENCE TO RELATED APPLICATION

This application is a continuation-in-part application based on my earlier application of the same title, Ser. No. 500,633, filed Aug. 26, 1974, now abandoned.

BACKGROUND OF THE INVENTION

1. Field of the Invention

This invention relates to conductor termination apparatus, and is more particularly concerned with the termination of conductors in insulation-piercing portions of contacts of an electrical connector wherein a plurality of conductors are terminated, in pairs, on opposite sides of an electrical connector in accordance with a selected termination schedule.

2. Description of the Prior Art

The prior art generally recognizes various methods and apparatus for inserting insulated conductors into respective insulation-piercing portions of contacts, including techniques for inserting insulated conductors into such contacts which are supported in rows within separate channels of an electrical connector.

In my copending U.S. Pat. application Ser. No. 407,781, filed Oct. 19, 1973, now abandoned, and assigned to Bunker Ramo Corporation, I disclose a pneumatically operated termination apparatus which is programmed by a slotted drum which is, in turn, indexed with a ratchet and pawl mechanism, in connection with a torsion bar, upon each insertion operation. The termination apparatus of that invention is embodied such that a connector is supported on a frame and a carriage which carries the insertion mechanism is movably mounted on the frame for movement along the connector. In that invention, the conductors are first dressed into the strain relief portion of a connector by an operator each time the apparatus indexes; the operator then operates a switch to cause insertion and subsequent indexing.

The prior art also recognizes the termination of conductors by means of a fluid controlled crimping process wherein conductors are fed to a station at which a contact, usually in the form of a terminal lug, is positioned about the conductor and crimped to provide mechanical and electrical connection thereto. Also, the prior art recognizes the utilization of mechanisms for aligning and inserting a plurality of stripped conductors into electrical contacts, whereafter such conductors are soldered or crimped to the contacts.

U.S. Pat. No. 3,766,622 discloses a conductor terminating apparatus for terminating a pair of conductors at a time in which an electrical connector is indexed step-by-step with respect to a pair of insertion rams, the indexing drive being provided by a spring-cable drive mechanism.

SUMMARY OF THE INVENTION

An object of the invention is to provide a conductor terminating apparatus for terminating insulated conductors, in pairs, in insulation-piercing contact portions of contacts supported by an electrical connector.

Another object of the invention is to provide a conductor guide structure which accurately aligns and positions a conductor with respect to an insulation piercing contact portion of an electrical contact, with the attendant object of initiating insertion operation only when the conductors are so aligned and positioned.

Another object of the invention is to provide a new and improved insertion mechanism which effects a partial pre-insertion of a conductor into a strain relief member carried by an electrical connector adjacent a terminating portion of a contact so as to hold the conductor in alignment therewith after a subsequent cutting operation, and to provide completion of insertion into the terminating portion and into the strain relief member simultaneously.

Inasmuch as the contact supporting portion of male connector parts generally have a slightly different width than the contact supporting portion of a female connector part of the same line of connectors, and as connectors of different lines have different widths, it is also an object of the invention to provide an apparatus for terminating conductors in male and female connector parts of the same line without the necessity of adjusting the apparatus, and in connector parts of different lines with a simple adjustment, while at the same time minimizing the insertion force necessary for accomplishing termination.

Another object of the invention is to provide an indicator which is operable to inform an operator which contact position of a connector is positioned adjacent an insertion blade to receive a conductor, with the attendant objects of providing an adjustment to position the indicator with respect to the lines of sight of operators of different heights, and the provision of the indicator as a remote indicator.

Another object of the invention is to provide an insertion tool which is selectively operable to a first mode of operation in which individual conductors of a pair of conductors are simultaneously inserted on opposite sides of a connector, and a second mode of operation in which the individual conductors of a pair of conductors may be inserted in a sequence on the same side of a connector. In the first mode of operation a single indexing along the connector is required, while in the second mode of operation two complete indexings are required.

According to the invention, these and other objects are achieved through the provision of an electrically driven terminating apparatus which comprises a frame which includes a base and a pair of spaced upstanding members. The various mechanisms for effecting indexing and insertion operations are supported by the upstanding members. One of the upstanding members includes a pair of bearings which receive shafts of a carriage therethrough for longitudinal movement. The same upstanding member mounts a connector support so that the carriage is movable with respect to a supported connector.

The carriage carries a pair of insertion lever mechanisms, each, in turn, carrying an insertion tool on a respective side of a supported connector. Each of the insertion levers is adapted for insertion movements which accommodate different widths of connectors.

One of the shafts which supports the carriage is hollow so as to receive a lead screw which is coupled to an indexing motor supported by the rear upstanding member. The lead screw has at least one ball disposed in the helical groove between at least one pair of adjacent threads, the ball or balls being captured in a holder affixed to the hollow carriage supporting shaft so that rotation of the lead screw effects movement of the carriage along the connector support.

The rear upstanding member also mounts an insertion drive motor which is part of an insertion drive comprising a first rotatably mounted elongate gear driven by the insertion drive motor and a rotatably mounted gear mounted in engagement with the elongate gear for rotation therewith and for longitudinal movement with respect thereto in that the shaft on this latter gear is rotatably mounted at the forward end thereof by the carriage. The forward end of this shaft carries an elliptical cam having a pair of diametrically opposed cam lobes for simultaneously operating the insertion lever mechanisms carried by the carriage.

In one embodiment of the insertion level mechanism, a first arm is pivotally mounted on the carriage and is coupled to an insertion tool at the upper end thereof to effect termination of a conductor during operation of the apparatus. A second arm, also pivotally mounted for movement about the same axis as the first arm, carries a roller at the lower end thereof which functions as a cam follower for following the movements of the elliptical cam. A bias spring connects the two second arms of the apparatus to urge the cam followers toward the cam. Each associated pair of first and second arms has a compression spring therebetween to transfer the operational force supplied by the cam to the first arm as an insertion force for the apparatus. In another embodiment the insertion arms are adjustable by cams to change their positions with respect to their pivot points so as to accommodate connectors of different widths.

A unique conductor guide structure is mounted on each side of the carriage for guiding and accurately positioning a conductor adjacent an insulation piercing contact portion carried by a supported connector. This guide structure includes, with respect to such a contact portion, a first downwardly and inwardly extending surface for guiding a first portion of the conductor toward the contact portion as the conductor is moved toward the contact portion under tension. A second guide, in the form of the edge of a guide member, directs a second portion of the conductor toward the contact portion, and a third guide, directed generally toward the contact portion, extends to a point aligned with the contact portion. In one embodiment the third guide slidably engages a third portion of a conductor to cause movement of that portion toward the contact portion at a slower rate than the first and second portions as the conductor is moved under tension to provide a snap-in action for the conductor to position the same in close proximity to and in accurate alignment with the contact portion. In a second embodiment the second and third guides cooperate to change the orientation of the conductor so that it is accurately aligned with and parallel to the contact portion and the end of the insertion blade. A fixed cutting member is mounted adjacent the guide structure of each embodiment for a subsequent conductor cutting operation.

The drive motor for the cam and the indexing motor are connected in a control circuit which includes a pair of serially connected switches on opposite sides of the insertion tool which are operated by the tensioned conductors subsequent to alignment by the guide. A third switch is selectively operable to bypass either of the serially connected switches so that a single conductor on one side of the apparatus may be employed to trip operation of the tool.

A position indicator circuit includes a plurality of contacts spaced the distances between the connector contacts. A grounded contact is mounted on one of the carriage support shafts to engage the spaced contacts in sequence and supply ground therethrough to a corresponding plurality of light emitting diodes which are mounted adjacent position indicia so that an illuminated diode indicates the indexed position of the carriage and insertion tool blades in terms of the connector contact number. The diodes are mounted in a housing which may mount on the insertion tool or at a remote location, the mount being pivotal as an adjustment for the line of sight of an operator.

BRIEF DESCRIPTION OF THE DRAWINGS

Other objects, features and advantages of the invention, its organization, construction and operation, will be best understood from the following detailed description of a preferred embodiment of the invention, taken in conjunction with the accompanying drawings, on which:

FIG. 3 is a front end view of the apparatus illustrated in FIGS. 1 and 2;

FIG. 4 is a fragmentary sectional view taken substantially along the line IV—IV of FIG. 1 and showing a first position of the insertion tool;

FIGS. 5 and 6 are fragmentary portions of the apparatus illustrated in FIG. 4 showing second and third position of the insertion tools;

FIG. 7 is a sectional view taken substantially along the line VII—VII of FIG. 1;

FIG. 8 is a fragmentary and partial sectional view taken substantially along the line VIII—VIII of FIG. 1;

FIG. 9 is a fragmentary view looking generally in the direction denoted by the line IX—IX of FIG. 1;

FIG. 10 is an electrical schematic diagram of a control circuit which may be employed in connection with the apparatus generally illustrated in FIGS. 1 and 2 for practicing the invention;

FIG. 11 is an electrical schematic diagram of a portion of the control circuit of FIG. 10 adapted for the selective single-side mode of operation;

FIG. 12 is a front elevation of the insertion tool in which the insertion arm mechanisms are adjustable to accommodate different widths of connectors;

FIG. 13 is a view similar to FIG. 7 showing another embodiment of a conductor guide structure;

FIG. 14 is a top view of the guide structure of FIG. 13 on both sides of the insertion tool;

FIG. 15 is a fractional top view of the insertion tool as shown in FIG. 1 additionally showing the sensing portion of the position indicator;

FIG. 16 is an electrical schematic circuit diagram of the position indicator circuit; and FIG. 17 is a front elevational view of the adjustable mount of the position indicator.

DESCRIPTION OF THE PREFERRED EMBODIMENTS

General Description

Figure 1:
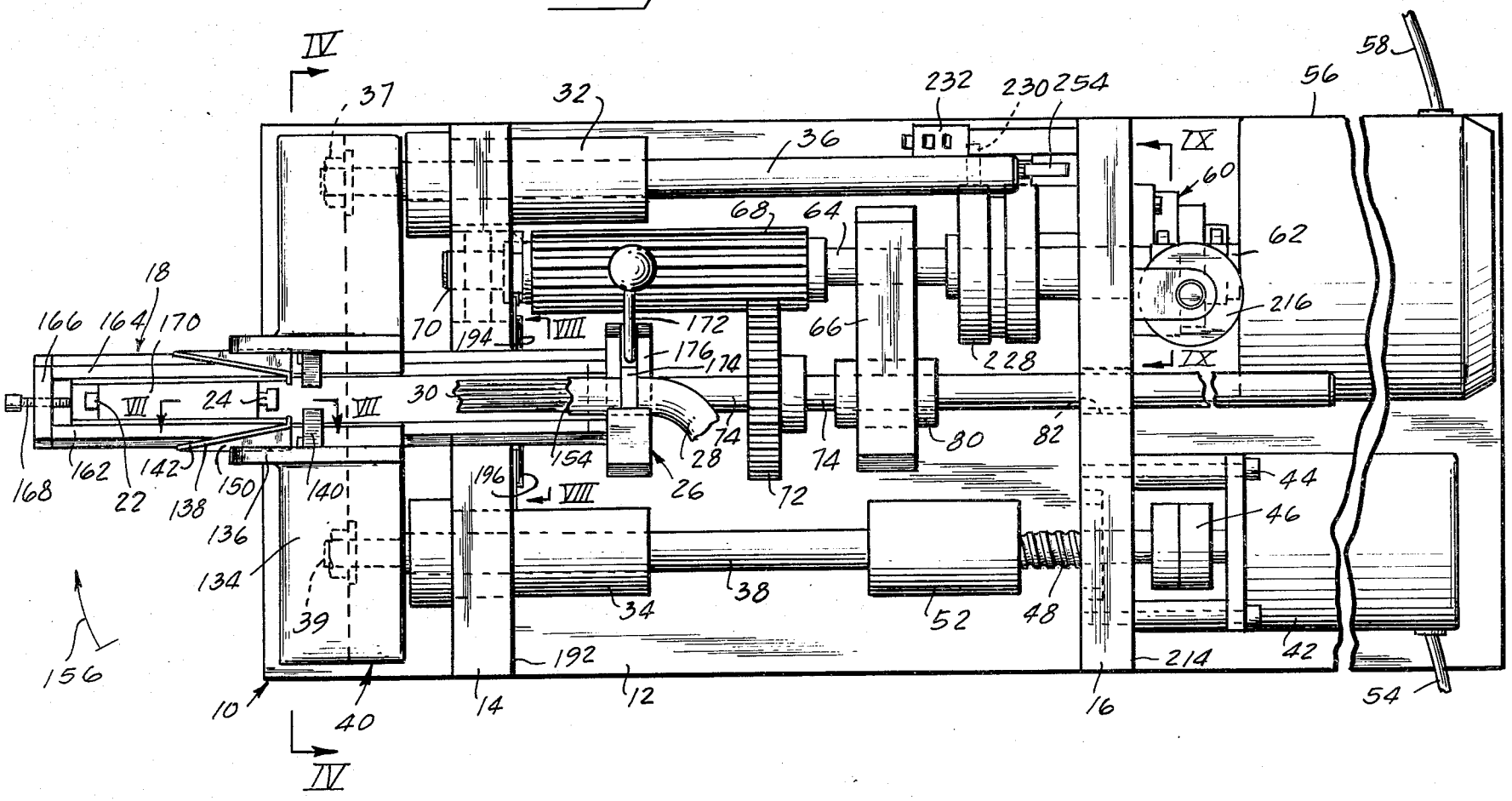
FIG. 1 is a plan view of a conductor insertion apparatus constructed in accordance with the invention.
Figure 2:
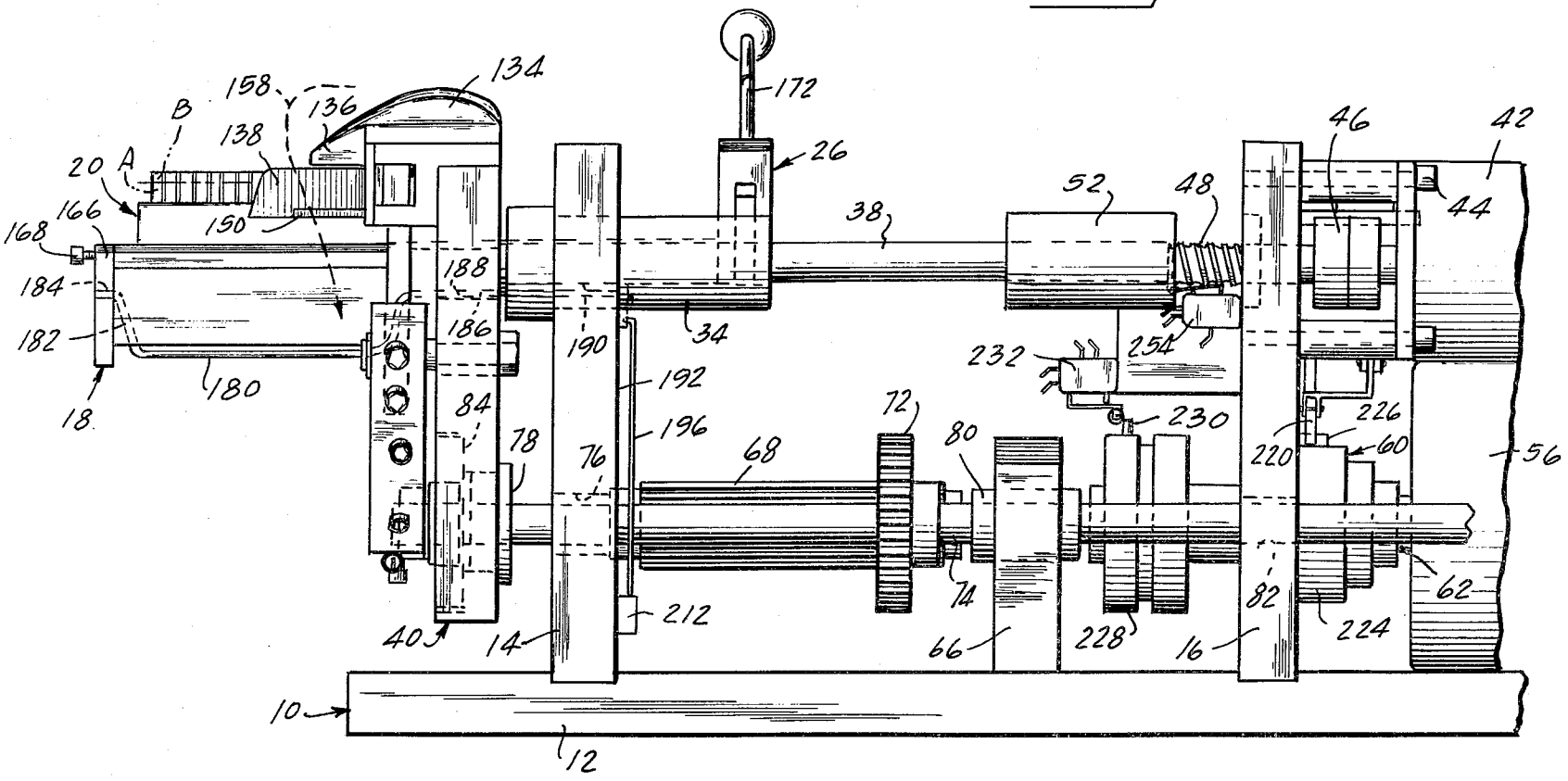
FIG. 2 is a side elevation view of the apparatus illustrated in FIG. 1.

Referring first to FIGS. 1 and 2, apparatus for inserting a plurality of insulated conductors in respective insulation piercing portions of contacts of an electrical device, such as an electrical connector, is generally illustrated as comprising a frame 10 including a base 12 which supports a front upstanding member 14, a rear upstanding member 16 and an intermediate upstanding member 66.

The front upstanding member 14 supports, in somewhat of a contilever fashion, a connector support 18 for supporting an electrical connector 20. The connector 20 plugs onto the connector support 18, in the manner of a mating connector part, by plugging over a pair of projections 22 and 24 which simulate a mating connector part. A cable clamp 26 is carried at the opposite end of the connector support 18 for holding a cable 28 which comprises a plurality of inductors 30 which are to be electrically terminated in respective insulation piercing contact portions of the connector 20. As is well known in the art, contacts having insulation piercing portions may be provided in a variety of forms and, when supported by a connector, may be supported in a number of ways. Inasmuch as the particular type of contact and the manner of supporting such contacts do not form a part of the present invention, and as the contacts and supports are generally well known in the art, further details as to this structure will not be provided here, with the exception of the provision of a strain relief mechanism. Referring to FIG. 2 in particular, and to the connector 20 thereof, an electrical connector or other electrical device may be provided with a plurality of contacts having insulation piercing portions aligned in a row in the area generally indicated with the reference A. The electrical device may also be provided with a strain relief mechanism, in the area generally referenced B, which may comprise a conductor receiving and holding slot which is aligned with a respective insulation piercing portion of a contact. Inasmuch as the strain relief mechanism may be utilized to advantage for conductor alignment and support prior to its utilization for strain relief, the present invention includes the recognition and utilization of strain relief mechanism during the termination operation as one of the primary features of the invention. A detailed discussion of this feature will be discribed below in connection with the conductor positioning, alignment, cutting and insertion operations.

The front upstanding member 14 carries a pair of linear bearings 32 and 34 which receive respective rods 36 and 38 therethrough for longitudinal movement with respect to the frame 10. The rods 36 and 38 are connected, as indicated at 37 and 39, as part of a carriage 40 which is also longitudinally movable with respect to the frame 10. This longitudinal movement is provided by means of an indexing motor 42 which is connected to the rear upstanding member 16 by suitable fastening means, such as the machine screws 44. The index motor 42 is generally aligned with the rod 38 and is coupled thereto by means of a flexible coupling 46, a lead screw 48 and a ball coupling 52. The flexible coupling 46 may be any of a variety of well known flexible coupling devices which obviate the necessity for totally accurate alignment of coupled shafts. The flexible coupling 46 is connected to a lead screw 48 which is received in a hollow portion (not shown) of the rod 38. The ball coupling 52 is fixed to the rod 38 and receives the lead screw 48. The ball coupling 52 is also well known in the art and provides at least one captured ball which runs in the thread of the lead screw 48 between the pitches of the screw. Usually, a plurality of such balls are included in such a ball coupling. It is readily apparent, therefore, that when the indexing motor 42 is energized by way of its leads 54, rotation of the lead screw causes longitudinal movement of the carriage 40.

An insertion motor 56, having electrical leads 58, is supported on the base 12 of the frame 10. This motor, as will be more readily appreciated from the description below, is continuously energized and coupled to rotate a cam 84 carried by the carriage 40, by way of a clutch and gear assembly. The clutch, generally referenced 60, may be any one of a number of well known clutches and is used to connect an output shaft 62 of the insertion motor 56 to a pinion shaft 64 which carries an elongate pinion 68, the elongate gear structure being provided to accommodate indexing and the resultant different carriage positions. The clutch 60 illustrated herein, and as will be understood from a more detailed description below, is operable to cause engagement of the shafts 62 and 64 for a single revolution to effect a 180° revolution of the cam 84 mounted within the carriage 40. The clutch may be a SRH-50 mechanism manufactured by the Machine Components Corp., Plainview, N.Y. The single revolution of the shaft 62, and of the shaft 64, is transferred to the elongate pinion 68, which is rotatably mounted at one end in the front upstanding member at 70, and via the shaft 64 which extends through a bore 67 in the upstanding member 66 for an opposite rotational mount via the clutch 60. A shaft 74 extends through a bore 76 in the upstanding member 14 and is rotatably mounted on the carriage in a bearing 78. In the opposite direction, the shaft 74 is mounted for rotation and longitudinal movement in a bearing 80 carried by the intermediate upstanding member 66 and extends through a bore 82 in the rear upstanding member 16. A gear 72 is carried on the shaft 74 in engagement with the elongate gear 68. Therefore, as the carriage moves longitudinally with respect to the frame 10, the gear 72 remains engaged with the gear 68 and the longitudinal movement of the shaft 74 is accommodated by the bearing 80 and by the bores 76 and 82 in the front and rear upstanding members 14 and 16, respectively. Inasmuch as two cam lobes are provided on the cam 84, a gear ratio of 1:2 is provided for the gears 68 and 72. This ratio and the number of turns of the insertion motor 56 coupled to the shaft 64 may, of course, vary for the particular applications and different numbers of cam lobes.

Insertion Mechanism

Referring now to FIG. 3, the forward end of the insertion apparatus is illustrated as comprising a pair of insertion lever mechanisms, only one of which will be described in that the apparatus is symmetrical and operates the same for each side of an electrical connector. Of course, this apparatus could be provided in other forms, both single and multiple, depending on the type of electrical device being terminated. Each insertion lever mechanism comprises a first insertion arm 86 which is pivotally mounted by a pin 88 on the carriage 40. At its lower end the first insertion arm 86 carries a roller 90 for engaging the cam 84 in response to the urging of a bias spring 89 connected between the first insertion arm 86 and its counterpart on the opposite side of the apparatus. As the cam 84 turns the roller 90, as a cam follower, is moved outwardly by cam lobe and inwardly by the bias spring 89. The outward movement of the arm 86 is transmitted to a second insertion arm 92 which includes a portion 94 which is pivoted about the pin 88. The transmission of the insertion force from the first insertion arm 86 to the insertion arm 92 is provided by means of a compression spring 98 which has one end received in a recess 99 of the arm 86 and another end which bears against a portion 96 of the second insertion arm 92.

Inward movement of the second insertion arm 92, at the urging of the bias spring 89, is provided by a screw 100 which is received through a bore 102 in the portion 96 and threaded into a threaded bore 104 of the arm 86.

The outward and inward movement of the insertion arm mechanism is changed to an inward and outward movement of an insertion tool 110 by way of a ball and socket type coupling including a rounded end 106 of the arm position 94 and a recess 108 in the insertion tool 110.

The insertion tools 110 are also symmetrical and only one of the tools will therefore be discussed in detail with respect to FIGS. 4–6. Referring to FIG. 4, a conductor 30 is illustrated as having been positioned for insertion adjacent the connector 20 and in alignment with the forward end of the insertion tool 110.

The insertion tool 110 includes two insertion blades or members. The first of these members, the member 112, is driven by the ball and socket coupling 106, 108 and includes a forward end 114 for inserting the conductor 30 into an insulation piercing contact portion or the like carried by an electrical device, such as the electrical connector 20. A second insertion member 116 is slidably carried on the member 112 and includes a forward end 118 for inserting the conductor into a strain relief mechanism which may be provided adjacent the terminating portion of a contact. In this exemplary embodiment, it is assumed that the electrical device is an electrical connector which has an insulation-piercing contact portion and a strain relief slot for gripping the conductor located adjacent, and in the drawing above, the insulation piercing contact portion.

It should be pointed out at this point, and it will be appreciated by those skilled in the art, that the leading lower edge of the insertion member 112 may be used to advantage to sever a conductor in operation with a member 152 which is mounted adjacent the connector 20. It will also be appreciated by those skilled in this art that cutting of the conductor during the insertion operation, particularly as a step prior to the actual insertion, may cause misalignment of the conductor due to the resiliency of the conductor and a tendency of the conductor to spring or jump out of alignment. Therefore, the insertion tool 110 is provided with the strain relief insertion member 116 for a second purpose, namely to partially pre-insert the conductor 30 into the strain relief mechanism prior to cutting and insertion into the insulation piercing portion of the contact. For this purpose, and as illustrated in FIG. 4, the forward end 118 of the strain relief insertion member 116 extends beyond the forward end 114 of the contact insertion member 112 and is normally urged toward this position by means of a spring 120 which bears against the rear surface 122 of the member 116 and against a surface 124 of or carried by the member 112. Therefore, as the second insertion arm portion 94 moves inwardly toward the connector 20, the forward end 118 of the strain relief insertion member 116 partially inserts the conductor 30 into the strain relief mechanism. As the member 116 encounters a sufficient resistance so as to initiate compression of the spring 120, the lower edge of the insertion member 112, in cooperation with the fixed cutting member 152, severs the conductor 30 and moves to a position illustrated in FIG. 5 whereat the conductor 30 is partially inserted in the strain relief member and the forward ends 114 and 118 of the insertion members 112 and 116 are in alignment. As inward movement of the member 94 continues, the conductor 30 is completely and simultaneously inserted in the strain relief member and in the insulation piercing contact portion of the connector 20 as the surface 122 engages the shoulder 132.

It will be appreciated that the insertion force is being transmitted from the cam 84 to the insertion tool 110 by way of the compression spring 98 illustrated in FIG. 3. This compression spring type drive provides several advantages. First of all, as the conductor is completely seated in the insulation piercing contact portion, further outward movement of the lower portion of the first insertion arm 86 is taken up by the spring 98. Any additional movement of the arm 86 at this point may at first appear unnecessary, and even somewhat detrimental; however, advantages arise from this relationship. As mentioned previously, a male connector of a particular connector line, because of certain production and mating requirements, is slightly wider in the termination area than a corresponding female connector. Therefore, that which appears to be excess movement for a male connector may advantageously be utilized for complete insertion in a female connector. If this additional movement were eliminated, an operator may experience an incomplete termination of female connectors. If the apparatus were designed for terminating only female connectors, excessive forces may be applied across a male connector. It has been found, however, that the apparatus can completely and satisfactorily terminate both male and female connectors with the structure disclosed herein, which obviates any necessity for two machines for terminating conductors in these similar widths of connectors. Greater differences in width may be easily accommodated by the adjustment structure of FIG. 12 which will be discussed below.

Referring again to FIG. 4, it will also be appreciated that, as in my aforementioned copending application Ser. No. 407,781, I provide for a horizontal linear motion of the insertion tool by providing a channel, defined by a pair of members 126 and 128, which slidably receives the insertion tool 110. This provides a linear translation of the arcuate movement of the arm portion 94 and holds the forward end of the insertion member 112 down as it encounters the conductor for severing the same in cooperation with the fixed cutting member 152. The arcuate motion of the arm 94 and the linear motion of the insertion tool 110 are accommodated by an elongate slot 130 in the member 128 for movement of the arm portion 94 and by the slight elongation of the downwardly extending sidewalls of the socket 108.

Conductor Guide Structure

Referring to FIGS. 1, 2 and 7, a conductor guide apparatus is illustrated on each side of the carriage 40. Each of these conductor guides includes an upper portion 134 which is rounded and smooth to prevent snagging of the conductors, a forwardly projecting portion which develops with the smooth surface of the portion 134 and which is spaced from a second guide part 138 to define a channel for receiving a conductor, and an inwardly extending portion 140 for guiding the conductor inwardly. The portion 140 has a forward surface 141 which, together with an inwardly extending portion 146 of the guide member 138, defines a conductor passageway 144 in which the conductor is aligned with the respective insulation-piercing contact portion and the associated strain relief member in the path of travel of the insertion members 112 and 116. The second guide part 138 also carries a horizontal member 150 which extends outwardly therefrom with an edge that is directed away from the insulation piercing contact portion and terminates at the passageway 141.

To position a conductor for insertion, an operator grasps the conductor and pivots the conductor in generally two planes about a pivot generally defined at 154 where the outer cable insulation of the cable 28 has been removed. In the horizontal plane the conductor is moved generally as indicated by the arrow 156 to position the conductor between the guide members 136 and 138. Somewhat simultaneously, the conductor is moved in the vertical plane, also pivoting at this time generally about the guide member 140 in the general manner indicated by the broken arrow 158. As the conductor encounters the various members of the guide structure, it is pulled by the operator to place the same in tension so that the following actions result. First of all, one portion of the conductor engages the inwardly directed portion 140 and slides down and inwardly therealong. Secondly, a portion of the conductor engages an upper outer edge 142 of the guide part 138 and slides therealong inwardly and rearwardly toward the passageway 144. As the conductor slides along the edge 142, a third portion of the conductor engages and slides along the horizontal member 150 toward the passageway and at a slower rate than the other mentioned portions of the conductor. The first actions carry portions of the conductor generally toward the positions they will occupy during insertion. The last action, however, with the conductor under tension, provides a "snap-in" action of the conductor as it reaches the passageway 144 so that the conductor is positioned as indicated in FIG. 4 ready for insertion.

Viewing the apparatus from above, as illustrated in FIG. 1, the guide is seen to have a pair of generally parallel L-shaped parts (136, 143; 138, 146) which define cooperating structures for receiving and accurately positioning a conductor in alignment with an insulation piercing portion of a contact and in the path of travel of an insertion tool. The first of these structures includes the element 136, 138, 140, 142 and 150, which provide a "target" for an operator, receive a conductor, and funnel the conductor toward the desired position. The second of these cooperating structures includes the elements 146 and 148 which define the passageway 144 along at least a portion of the path of travel of the insertion tool. The conductor is therefore funneled toward and snapped into the passageway and toward the contact (via the guide member 150) and accurately aligned by confinement in the passageway between the elements 146 and 148.

A preferred conductor guide 278 is illustrated in FIGS. 13 and 14. The guide 278 comprises a pair of generally L-shaped guide members 280 and 282. The guide member 280 comprises a vertical portion 284 and a horizontal portion 292 having arcuate-shaped edges 288 and 296, respectively. The guide member 282 comprises a vertical portion 286 and a horizontal portion 294 having arcuate-shaped edges 290 and 298, respectively. The vertical portions 284 and 286 each carry an inwardly directed flange 300 and 302, respectively, which with the adjacent inwardly extending portions 140 to form respective conductor receiving channels 304 and 306 which extend between the forward ends 114 of the respective insertion blades and the connector.

In positioning the conductors an operator handles and manipulates the conductors as discussed above for the snap-in type guide structure. In this embodiment the forwardly extending "horn" portions 136 have been eliminated and a conductor is "targeted" to the rear of the arcuate-shaped edges, for example the rear of the edges 288 and 296. As before, the portions 140 guides a conductor downwardly and inwardly toward the channels 304, 306. The edges 288 and 290 guide the conductors downwardly and to the rear toward the channels. The edges 296 and 298 guide lower portions of the conductors inwardly and toward the rear. The combined guiding actions changes a generally horizontal orientation of a conductor to a vertical orientation and accurately positions and aligns the conductors in the channels in front of the insertion blades.

Connector Support Structure

Prior to terminating an electrical device, for example the connector 20, the same is mounted on the connector support 18 which comprises a base 160 having a pair of vertical sidewalls 162 and 164, as can be seen in FIGS. 1, 2 and 4, and a forward wall 166. An adjustment screw 168 extends through the forward wall to engage either the electrical device or a device mount 170 which is slidably carried between the walls 162 and 164. The screw 168 therefore provides for accurate longitudinal alignment of the electrical device with the insertion tools. The device mount 170 carries the aforementioned projections 22 and 24, in this case simulating a mating connector part for the connector 20.

The cable 28 is mounted in the cable clamp 26 which includes a spring loaded handle 172 having a clamping portion 174 which is spring pivoted across the top of the cable 28 after the cable has been placed in a vertical slot 176.

After the cable 28 has been clamped in place and the connector 20, or other electrical device, has been mounted on the connector support 18, the conductors may be guided, in this case in pairs, through the guide structure for electrical termination.

Operating Lever Mechanism

After the conductors have been moved into the desired positions, and with tension still being applied to the conductors, the free ends of the conductors are moved inwardly to engage respective operating levers 178 and 180 which are carried by the connector support 18. Referring to FIGS. 2, 4 and 8, the operating levers 178 and 180 are illustrated in detail. The operating lever structure is symmetrical; therefore, only the lever mechanism 180 will be set forth in detail. The operating level 180 includes an elongate portion which is bent upwardly and inwardly at its forward end at a portion 182 and has a forward end portion 184 which is pivotally mounted in the end plate 166. A similar configuration is provided toward the rear end of the operating lever 180 wherein the counterpart 186 of the end portion 184 extends through a bore 188 in the carriage 40 and is pivotally mounted through a bore 190 in the front upstanding member 14.

Referring particularly to FIG. 8, which is a rear view of a portion of the upstanding member 14, the members 178 and 180 are illustrated as fixed to and forming respective pivots for a pair of levers 179 and 181. These levers 179 and 181 are pivotally connected to respective actuating rods 194 and 196 carried to the rear of the surface 192 of the upstanding member 14. The actuating rods 194 and 196 are respectively pivotally connected to a pair of actuating members 198 and 200 which are also pivotally connected at 206 and 208 to the front upstanding member 14. The actuating members 198 and 200 operate switches 210 and 212 which, in this particular example, are connected in series, so that both conductors must be in the desired location and the free ends thereof pulled inwardly against the operating levers 178 and 180 to initiate operation of the insertion apparatus.

Referring to FIGS. 1, 2, and 9, the control portion of the apparatus for providing transmission of a single revolution from the insertion motor 56 to the elongate gear 68 is illustrated, FIG. 9 showing a portion of the rear surface 214 of the rear upstanding member 16. A solenoid 216 is mounted by suitable means (not shown in detail) on the rear surface 214 of the rear upstanding member 16 and includes a movable member 218 which is pivotally connected to a pawl 220. The pawl 220 is pivotally connected at 222 to the upstanding member 16. The pawl 220 engages a single ratchet 226 which is carried on the outer periphery of a ring 224 of the clutch 60. It is readily apparent that momentary energization of the solenoid 216 to momentarily release the pawl 220 from the ratchet 226 will provide a single revolution of the ring 224. The particular clutch employed couples rotary motion therethrough upon rotation of the ring 224 and prevents the transmission of rotary motion when the ring 224 is held against rotation. In FIG. 2 the shaft 74 is illustrated as carrying a ring 228 for rotation therewith. The ring 228 further carries a projection 230 which serves to operate a switch 232 as the ring rotates one revolution. Therefore, the switch 232 may advantageously control deenergization of the solenoid 216 prior to the completion of one revolution of the ring 224 so that the pawl 220 engages the ratchet 226 upon completion of one revolution. The switch 232 may also be advantageously employed to initiate indexing, as will be brought out below.

Control Circuit

Referring to FIG. 10, a simplified electrical circuit is illustrated for controlling the insertion and indexing operations. The circuit is illustrated as comprising a pair of serially connected switches 210 and 212 (FIG. 8) for energizing the solenoid 216 from an electrical supply (V). Therefore, as the conductors are properly positioned and the free ends thereof are brought inwardly against the operating levers 178 and 180, the switches 210 and 212 are closed to energize the solenoid 216 to cause transmission of one revolution of the motor 50 to the elongate gear 68 and from the transmission of one half of a revolution to the cam 84 to operate the insertion lever mechanisms and the insertion tools carried thereby. It should be noted that the operation of the switches 210 and 212 is a momentary operation in that, as the conductors are cut immediately prior to insertion, the tension thereof is eliminated and the biasing of the switch actuating mechanisms, either through the switches themselves or by auxiliary springs, pivots the operating levers 178 and 180 in the opposite direction to open to switches 210 and 212. Momentary energization of the solenoid 216 pulls the pawl 220 to disengage the ratchet 226 and permit rotation of the ring 224 to transmit one revolution of the insertion motor 56 to the elongate gear 68, as described above. Also as described above, the ring 228 rotates and carries a projection 230 to operate a switch 232.

The switch 232 may operate through a delay circuit to insure tool withdrawal before indexing. A more simple approach, and one which adequately serves for describing the present invention, resides in the provision of a pair of serially connected switches 234 and 236 (see FIG. 3) which operate after insertion and withdrawal of the insertion tools as the insertion arms 86 return to their rest positions. When this occurs, an index initiating signal, here a ground signal, is permitted to be transmitted via the switches to an electronic switch 238 which is interposed between a source of pulses 240 and an electronic counter 242.

The electronic switch 238 may be any of a well known number of transistor switching arrangements which operates in response to an input signal, such as ground, to complete a signaling path. A source of pulses 240 may advantageously comprise an oscillator which runs continuously so that pulses are always available. Upon receipt of the ground signal, the switch 238, which may include a flip-flop input signal response circuit, closes to pass the pulses from the pulse generator 240 to the motor 42. Each index position (space between insulation piercing contact portions) is related to the pitch of the lead screw 48 and the rotation supplied thereto by the motor 42. The amount of rotation of the motor 42 is dependent upon the number of pulses supplied. Therefore, a counter 242 is connected to receive and count a number of pulses which represent the spacing between contact portions and is responsive to such number of pulses to open the switch 238. This occurs for each indexing operation. The counter 242 is connected to a second counter 244, an accumulator, so that each index is registered against the number of total positions along the electrical device. The total number of positions may be pre-set and encoded into the counter 244 in various ways which are well known in the art. As an example, a rotary switch has been illustrated for selecting seven, 12, 18, 25, and 32 positions. Selection of one of these positions, 25 positions being illustrated, pre-sets the accumulator counter 244 and each input from the index counter 242 steps the accumulator counter 244 against the selected number of positions.

Upon reaching the last position, the accumulator counter 244 is loaded for the last time by the index counter 242 and emits a signal to close a second electronic switch 250 to connect the pulse generator 240 to the indexing motor 242 by way of an inverter 252 and a switch 254. In this manner, pulses of the opposite polarity are connected to operate the indexing motor 42 in the reverse direction to return the carriage toward its first position. As the carriage reaches its first position, the switch 254 is actuated by the rear end of the carriage rod 36 to open the return circuit and present further rearward driving of the carriage.

The switch 254 may also be coupled to or include contacts 256 for providing a reset signal to the accumulator counter 244 to remove the energizing from the electronic switch 250 and place the system in condition for electrical termination of another device.

The accumulator 244 may also be provided with a reset switch 248 to energize its last counting stage in such a manner as to simulate complete indexing so that the carriage may be returned. This may be necessary in the event of a malfunction, or in the event that an operator wishes to terminate an electrical device whose total number of index positions cannot be preset in the accumulator counter 244, or if a number of indexes less than a preset total are to be made.

Single-Side Mode of Operation

The single-side mode of operation may be employed to terminate on only one side of a connector, or selectively on both sides of a connector one side at a time. In the telephone industry it has been found to be of particular advantage in some applications to terminate the individual conductors of a pair of conductors on the same side of a connector, perhaps immediately adjacent each other, rather than on opposite sides across from each other. The present invention readily lends itself to such operations.

Examination of the insertion tool will reveal that there are many expedient structures for selectively latching one of the switches 210 and 212 closed, such as mechanical latches mounted on the cantilever connector support or on the upstanding member 14 for latching the members 178—200 in their switch closed positions. However, a more simple technique is illustrated in FIG. 11 wherein a simple electrical switch may be operated to accomplish the same result.

Referring to FIG. 11, a portion of the circuit of FIG. 10 is illustrated, namely the serially connected switches 210 and 212 and the solenoid 216. In addition, a switch 260, advantageously a double-throw or a three-position switch, is connected in circuit with the switches 210 and 212 to provide a single-side termination operation. For simplicity a single-pole double-throw switch has been illustrated.

Assuming for example that an operator wishes to terminate conductors on only the left-hand side of a connector, as viewed facing the tool, the switch 260 is operated to engage the movable contact 261 with the fixed contact 260L as illustrated in FIG. 11 to electrically bypass the switch 212 which is ordinarily operated in positioning a conductor on the right-hand side of the tool. Insertion and indexing may be initiated on the left-hand side without the necessity of operating the members 180, 181, 196, and 200.

After making the required number of terminations on one side of a connector an operator may remove the connector or reverse the switch 260 and terminate along the opposite side of the connector, depending on the requirements of the contact termination schedule.

Connector Width Adjustment

Although an insertion tool may be designed and constructed to properly terminate connectors of generally the same width, such as male and female connectors of the same connector line, as was disclosed above with reference to the insertion mechanism of FIG. 3, different connector widths of other lines of connectors may also be safely terminated without fear of incomplete termination or contact damage through the provision of a simple adjustment of the insertion mechanism. A slightly different insertion lever mechanism is illustrated in FIG. 12 in which the operation of the levers and the spring are the same as above for male and female connectors of the same line, or for similar widths of connectors. Remembering that the insertion tool is symmetrical, on the right-hand portion of FIG. 12 an insertion lever 262 is illustrated as being provided with a circular opening 264 and a threaded bore 266, while an adjustment structure is illustrated on the left-hand portion of FIG. 12 as comprising a circular cam 268 which is rotatable about the pin 88 within a circular opening corresponding to the circular opening 264. The cam 268 is secured to a plate-like quadrant lever 270 which includes a hole 272 and a slot 274 which may be rotated into alignment with a threaded bore corresponding to the threaded bore 266. A threaded stud or machine screw 275 locks the plate 270 with the slot 274 or the hole 272 positioned over the threaded bore.

A rearwardly extending flange 277 carries an adjustment screw assembly 276 for an adjustment to position the quadrant lever 270 to position the hole 272 with respect to the threaded bore as an accurate adjustment for certain connector widths, such as male and female connectors of the same line as described above in connection with FIG. 3. A slot, such as the slot 274, may be positioned over the threaded bore for a connector of different widths, such as may be supplied by a different manufacturer. As is readily apparent from the drawing, rotation of the quadrant lever 270 causes the cam 268 to reposition the lever arm 262 with respect to its pivot point, whereby rotation of the cam in one direction causes the upper end of the insertion lever to be moved in one direction with respect to the connector, while opposite rotation causes an opposite movement of the lever arm. With the movement of the lower end of an insertion lever fixed by the cam 84, movement of the upper end is changed by the cam 268 to control the length of an insertion stroke of the associated insertion blade.

Position Indicator

Inasmuch as the insertion tool may be utilized in single-sided and double-sided operation, as termination schedules may be changed, and as the operator may wish to check indexing with respect to desired position for various reasons, a position indicator may be provided as generally illustrated in FIGS. 15–17.

Referring first to FIG. 15, a longitudinally extending member 310 is supported by the upstanding members 14 and 16 and is secured thereto by screws 312 and 314. A second pair of screws 316 and 318 secures a position contact support 320 to the member 310. The position contact support 320 carries a plurality of contacts 322 spaced along one edge corresponding to the spacing of the insulation piercing contacts of a connector. A feeler contact in the form of a machine-grounded ball contact 324 is mounted on a block 325 carried on the carriage support shaft 36. As the carriage is indexed the feeler contact 324 sequentially engages and sequentially grounds the contacts 322. The contacts 322, 324 and their supporting structure therefore constitute a position sensor.

Each of the contacts 322 are connected to individual conductors of a cable 326 which is terminated by a connector unit 328 which is mateable with a cooperable connector unit 330 (FIGS. 16 and 17).

Referring to FIG. 16, an electrical schematic diagram illustrates that the position indicator may also comprise a plurality of light emitting diodes 336 which are connected in common on the anode side to a positive supply voltage and which are individually connectible to ground on the cathode side via conductors 334 of a cable 332 and the aforementioned elements 322–330. As ground is sequentially applied to the contacts 322, the diodes 336 sequentially become illuminated as a means of displaying position.

FIG. 17 illustrates a display console in which the diodes 336 may be mounted on, adjacent or remote from the insertion tool. The console may comprise an indicia card 340 having holes 338 therein for mounting and viewing the diodes 336. The indicia card 340 is carried as a cover of a housing 342 which has a pair of downwardly projecting lugs 344 and 346. The lug 344 has a bore 348 and the lug 346 has a bore 350 for receiving a shaft 352 having a threaded end 354. The shaft 352 carries a wheel-type knob 364 at its other end and adjustably secures the console to a mounting bracket. The mounting bracket is generally U-shaped or H-shaped and may comprise a pair of vertical members 358 and 362 and a cross member 372. The vertical member 358 has a threaded bore 356 for receiving the threaded end 354 of the shaft 352, and the vertical member 362 includes a bore 360 for receiving the shaft 352, so that the console may be pivoted about the shaft 352 and releasably locked in position by rotation of the knob 364 to clamp the lugs 344 and 346 between the members 358 and 352 as a shoulder 366 of the knob and the threads squeeze the members toward each other. The lower ends 368 and 370 of the members 358 and 362 and/or the cross member 372 may be secured to a support by any suitable means. A support may be a housing for the insertion tool, the frame of the tool, or a remote table, bench or the like. The pivotal mounting permits an operator to adjust the console for his direct line of sight. As a remotely mounted console, the distance of the remote location from the insertion tool is only limited by cable length.

Although I have described my invention by reference to a particular illustrative embodiment thereof, many changes and modifications of the invention may become apparent to those skilled in the art without departing from the spirit and scope of the invention. I therefore intend to include within the patent warranted hereon all such changes and modifications as may reasonably and properly be included within the scope of my contribution to the art.

I claim:

1. A conductor terminating mechanism for terminating a plurality of insulated conductors in respective terminating portions of respective spaced apart electrical contacts which are supported in alignment by an electrical device, comprising:

device support means for supporting the electrical device;

conductor support means for supporting a plurality of free-ended insulated conductors;

a carriage, said carriage and said device support means mounted for relative movement in the direction of alignment of the electrical contacts between points spaced a distance of at least the spacing between the terminating portions of the electrical contacts;

an insertion tool mounted on said carriage for movement toward the electrical device and including at least one insertion blade for engaging and pressing a conductor into the terminating portion of the electrical contact;

a conductor guide means mounted on said carriage for accurately positioning a conductor in an interference relationship with the insertion tool between the tool and a terminating portion of an electrical contact as the conductor is moved, under tension, toward that termination portion;

an insertion programmer operable to effect movement of said carriage to the spaced points; and insertion control means including switch means operated upon accurate positioning of the conductor to effect movement of the insertion tool.

2. A conductor terminating apparatus for terminating a plurality of conductors in respective contact portions supported spaced apart and in alignment by an electrical device, comprising:

device support means for holding the device with the contact portions oriented to receive respective conductors;

guide means for accurately positioning and aligning a conductor adjacent a contact portion;

a carriage mounted for movement relative said device support means in the direction of alignment of the contact portions;

at least one insertion lever mounted on said carriage for movement toward and away from the device, said lever and said support means mounted for movement one relative the other;

an insertion tool mounted on said insertion lever to engage and press a conductor into a contact portion;

control means connected to said support means and to said lever and operable to index one relative to other between points spaced a distance of at least the spacing between the contact portions and to move said lever toward and away from the electrical device; and adjustable mounting means for said insertion lever to selectively limit the extent of movement of said lever toward the electrical device.

3. A conductor terminating apparatus according to claim 2, wherein said adjustable mounting means includes pivot means for said insertion lever and means for adjusting the position of said insertion lever on said pivot means.

4. A conductor terminating apparatus according to claim 3, wherein said pivot means comprises a pin, said lever includes a circular opening, and said means for adjusting includes a circular cam in said circular opening and having an off-center bore receiving said pin.

5. A conductor terminating apparatus for terminating a plurality of conductors in respective contact portions spaced apart and aligned in a row and supported by an electrical device, comprising:

device support means for holding the device with the contact portions oriented to receive respective conductors;

a carriage mounted for movement relative to said support means in the direction of alignment of the contact portions;

guide means for accurately positioning and aligning a conductor adjacent a contact portion;

at least one insertion lever mounted on said carriage for movement toward the device;

an insertion tool mounted on said insertion lever to engage and press a conductor into a contact portion; and a control circuit operable to index said carriage between points spaced a distance of at least the spacing between the contact portions and for moving said lever toward the electrical device, including switch means operated upon accurate positioning of a conductor to cause operation of said control circuit.

6. A conductor terminating apparatus according to claim 5, wherein said insertion lever is pivotally mounted on said carriage, and comprising adjustment means for adjusting the mounting of said lever with respect to its pivot to determine the limit of movement of said insertion tool toward the electrical device.

7. A conductor terminating apparatus according to claim 6, wherein said adjustment means comprises a cam for moving said insertion lever and a cam lever attached to said cam and releasable locking means for locking said cam lever to positions on said insertion lever.

8. A conductor terminating apparatus according to claim 7, wherein said insertion lever includes a circular hole therein, said cam mounted in said circular hole and mounted off-center on the pivot of said insertion lever and rotatable by said cam lever to adjust the position of said insertion lever with respect to its pivot.

9. A conductor terminating apparatus according to claim 5, comprising a position indicator for indicating the position of said carriage relative said device support means.

10. A conductor terminating apparatus according to claim 9, wherein said position indicator comprises a sensor for sensing the relative position of said carriage and display means connected to said sensor and operable to display the position of said carriage.

11. A conductor terminating apparatus according to claim 10, wherein said sensor comprises a plurality of position sensing contacts mounted fixed with respect to said carriage and spaced apart corresponding to the spacing of said connector contact portions and a feeler contact connected to a first potential and mounted to move with said carriage to sequentially engage said position sensing contacts, and said display means comprises a plurality of electrically operated indicators connected on one side to a second potential and connected on the other side to said position sensing contacts to receive the first potential for sequential energization.

12. A conductor terminating apparatus according to claim 11, wherein said plurality of indicators comprises a plurality of light emitting diodes.

13. A conductor terminating apparatus according to claim 12, wherein said display means comprises a housing including an indicia card relating said light emitting diodes to contact portion positions.

14. A conductor terminating apparatus according to claim 13, comprising means for adjustably mounting said housing to a supporting surface.

15. A conductor terminating apparatus for terminating a plurality of insulated conductors in respective insulation piercing contact portions arranged in respective rows on each side of an electrical connector, said apparatus comprising:

connector supported means for supporting the connector with the contact portions oriented to receive respective conductors when the same is brought into alignment therewith;

a pair of insertion lever mechanisms each mounted in alignment with the other on opposite sides of said connector support means;

a pair of insertion tools, each mounted on a respective insertion lever mechanism for engaging and pressing a conductor into a respective insulation piercing contact portion;

an insertion lever carriage mounted for movement along the electrical connector between points spaced a distance of at least the spacing between adjacent contact portions; and a control circuit operable to index said carriage and operate said insertion lever mechanisms, including switch means operated by the conductors as they are moved into alignment with the contact portions.

16. A conductor terminating apparatus according to claim 15, wherein said lever mechanisms comprise:

a pair of pivotally mounted first arms, each of said first arms carrying a respective insertion tool;

a pair of second arms each of which is associated with and pivotally mounted for rotation about the same axis as a respective said first arm;

a pair of cam followers each of said cam followers carried on a respective second arm;

a rotatable cam including a pair of diametrically opposite cam lobes for imparting an operating force simultaneously to each of said cam followers;

a pair of compression springs, each of said springs coupling an associated first and second arm to transfer the operating force into an insertion force; and biasing means urging said cam followers toward said cam.

17. A conductor terminating apparatus according to claim 15, wherein each of said lever mechanisms comprises:

a first pivotally mounted arm carrying said insertion tool;

a second pivotally mounted arm adapted to receive an operating force; and a compression spring coupling said first and second arms to transfer the force into an insertion force.

18. A conductor terminating apparatus according to claim 15, wherein said switch means includes a pair of serially connected switches and a corresponding pair of conductor operated switch actuating mechanisms, and further comprising means for selectively simulating actuation of a switch for operation of said apparatus in response to movement of a single conductor into alignment.

19. A conductor terminating apparatus according to claim 18, wherein the last-mentioned means comprises a bypass switch connected to said pair of serially connected switches and selectively operable to bypass one of said serially connected switches.

20. A conductor terminating apparatus according to claim 15, comprising a conductor guide means including first and second guide means for receiving respective conductors and accurately positioning and aligning the same adjacent respective contact portions as the conductors are manually moved toward the contact portions.

21. A conductor terminating apparatus according to claim 20, wherein each of said guide means comprises:

first means defining a conductor passageway along at least a portion of the path of the insertion tool and directed toward the terminating portion of the contact; and second means directed toward the passageway to a point adjacent the path of the tool for slidably engaging the tensioned conductor and imparting a snapping action of the conductor into the passageway and toward the terminating portion of the contact.

22. A conductor terminating apparatus according to claim 20, for a connector which has a conductor receiving strain relief member adjacent each of the contact portions, wherein each of said insertion tools comprises:

a first insertion member having a forward end for movement toward and for engaging the conductor opposite the strain relief member;

a second insertion member adjacent and mutually movable with said first insertion member and having a forward end for engaging the conductor adjacent the engagement thereof by said first member;

said forward end of said first insertion member normally extending forward of said forward end of said second insertion member to engage and initiate insertion of the conductor into the strain relief member prior to initiation of insertion of the conductor into the insulation piercing portion of the electrical contact; and mounting means mounting said first insertion member for movement relative said second insertion member to provide alignment of said first and second ends and simultaneous complete insertion of the conductor into the strain relief member and into said insulation piercing portion of the electrical contact.

23. A conductor terminating apparatus for terminating a plurality of insulated conductors in respective insulation piercing contact portions of electrical contacts spaced apart and aligned in rows on opposite sides of and supported by an electrical connector, comprising:

a frame and a connector support carried on said frame for supporting a connector with the insulation piercing contact portions oriented to receive insulated conductors;

a carriage mounted for movement on said frame with respect to said connector support;

first and second guide means carried on said carriage on opposite sides of said connector support to accurately align and position respective conductors adjacent respective contact portions as the conductors are moved, under tension, toward such contact portions;

an indexing motor mounted on said frame and coupled to said carriage, said indexing motor operable to move said carriage along said frame in increments of at least the spacing between adjacent contact portions;

a pair of insertion tools, each adapted to engage and press a conductor into an insulation piercing contact portion;

a pair of insertion lever mechanisms pivotally carried on said carriage on opposite sides of said connector support, each of said lever mechanisms carrying a respective insertion tool;

an insertion drive including an insertion motor coupled to and operable to pivot said lever mechanisms to cause insertion of a pair of conductors; and a control circuit connected to operate said indexing and insertion motors, and including switch means manually operated by properly positioned conductors to cause insertion and indexing.

24. A conductor terminating apparatus according to claim 23, wherein said switch means is mounted on said frame, and comprising a pair of switch operating levers mounted on said connector support.

25. A conductor terminating apparatus according to claim 23, wherein said connector support comprises an upstanding member mounted on said frame and a cantilever member mounted on said upright member, said switch means mounted on said upright member, and comprising a switch operating linkage including an operating lever mounted on said cantilever member, a switch actuating member mounted on said upright member, and a coupling lever coupling said operating lever and said actuating member.

26. A conductor terminating apparatus according to claim 23, comprising:

a lead screw connected to said indexing motor; and a ball coupling receiving said lead screw and connected to said carriage, said ball coupling including at least one ball between two adjacent pitches of said lead screw.

27. A conductor terminating apparatus according to claim 23, wherein said insertion drive comprises a single revolution clutch coupling said insertion motor to said lever mechanisms, said clutch including a rotatable clutch ring controlling the clutching operation, a solenoid in said control circuit operated for an insertion operation, and a ratchet and pawl coupling said solenoid to said clutch ring to normally prevent rotation thereof, operation of said solenoid causing momentary disengagement of said ratchet and pawl mechanism and engagement of said clutch.

28. A conductor terminating apparatus according to claim 23, wherein each of said lever mechanisms comprises a cam follower and said insertion drive comprises a rotatable cam for simultaneously operating said cam followers and said insertion lever mechanisms.

29. A conductor terminating apparatus according to claim 23, wherein each of said lever mechanisms comprises:

a first pivotally mounted arm carrying said insertion tool;

a second pivotally mounted arm adapted to receive an operating force; and a compression spring coupling said first and second arms to transfer the force into an insertion force.

30. A conductor terminating apparatus according to claim 29, wherein said first and second arms are pivotally mounted for rotation about the same axis.

31. A conductor terminating apparatus according to claim 29, comprising a pair of rollers mounted on respective ones of said second arms as cam followers, and wherein said insertion drive includes a cam having a pair of diametrically opposed cam lobes for simultaneously operating said cam followers.

32. A conductor terminating apparatus according to claim 29, comprising a bias spring connecting said lever mechanisms to normally urge said insertion tools away from the electrical connector.

33. A conductor terminating apparatus for terminating a plurality of insulated conductors in respective insulation piercing contact portions of electrical contacts which are spaced apart and aligned in a row and supported by an electrical connector, comprising:

a frame;

a connector support carried on said frame for supporting a connector with said contact portions oriented to receive insulated conductors;

a conductor support carried on said frame for holding a plurality of conductors;

a carriage mounted for movement on said frame along the row of contact portions;

a conductor guide mounted on said carriage for receiving and accurately aligning a conductor with a contact portion, said guide including first means for directing a portion of a conductor toward a contact portion at a first rate and second means for guiding another portion of the conductor toward the contact portion at a rate that is slower than said first rate until the latter portion reaches a predetermined point as the conductor is moved, under tension, toward the contact portion to impart a snapping movement of the conductor into proximity of and alignment with the contact portion;

insertion tool means movably mounted on said carriage for engaging and pressing a conductor into a contact portion; and control means coupled to said carriage and to said insertion tools means and operable to index and step said carriage to predetermined positions along the row of contacts and operate said insertion tool means at said positions to cause termination of the conductors in the respective contact portions.

34. A conductor terminating mechanism for pressing an insulated conductor into an insulation piercing portion of an electrical contact with a force imparted by an insertion tool which moves along a predetermined path, comprising:

support means for supporting the electrical contact with the insulation piercing portion thereof in the path of the insertion tool and conductor guide means for accurately aligning the conductor adjacent the insulation piercing portion of the electrical contact in the path of the insertion tool as the conductor is moved, under tension toward the insulation piercing portion of the electrical contact, including a first guide directed toward the insulation piercing portion of the electrical contact for slidably engaging the conductor;

a second guide directed toward the insulation piercing portion of the electrical contact for slidably engaging the conductor; and together with said first guide, defining a conductor passageway along the path of the insertion tool, and a third guide directed toward and extending to the passageway to cause the tensioned conductor to snap into the passageway and toward the insulation piercing portion of the electrical contact.

35. A conductor terminating mechanism for pressing a conductor into an electrical terminating portion of an electrical contact with a tool which moves along a predetermined path, comprising:

support means for supporting the contact with its terminating portion in the path of the tool; and conductor guide means for accurately aligning the conductor with the terminating portion of the contact in the path of the tool as the conductor is moved toward the contact under tension, including first means defining a conductor passageway along at least a portion of the path of the insertion tool and directed toward the terminating portion of the contact, and second means directed toward the passageway and extending to a point adjacent the path of the tool for slidably engaging the tensioned conductor and imparting a snapping action of the conductor into the passageway.

36. A conductor terminating mechanism according to claim 35, wherein said second means is mounted on and extends from said first means.

37. A conductor terminating mechanism according to claim 35, wherein said passageway defining first means comprises a pair of generally parallel L-shaped surfaces, the base of the L disposed along the path of the tool.

38. A conductor terminating mechanism according to claim 37, wherein said second means includes a portion extending from one of said L-shaped surfaces and having an edge for slidably engaging the conductor.

39. A conductor terminating mechanism according to claim 35, wherein said passageway defining first means comprises:

a first part including a first surface for slidably engaging and directing the conductor toward the terminating portion of the electrical contact and a first L-shaped surface intersecting said first surface; and a second part including a second L-shaped surface parallel to said first L-shaped surface, said second L-shaped surface including an edge for slidably engaging and directing the conductor toward the terminating portion of the electrical contact.

40. A conductor terminating mechanism according to claim 39, wherein said second means includes a plate portion having an edge which slidably engages the conductor.

41. An insertion mechanism for pressing an insulated conductor into an insulation piercing portion of an electrical contact which has a conductor receiving strain relief adjacent thereto, said mechanism comprising:

a first insertion member having a forward end for movement toward and for engaging the conductor opposite the strain relief;

a second insertion member adjacent and mutually movable with said first insertion member and having a forward end for engaging the conductor adjacent the engagement thereof by said first member, said forward end of said first insertion member normally extending forward of said forward end of said second insertion member to engage and initiate insertion of the conductor into the strain relief prior to insertion of the conductor into the insulation piercing portion of the electrical contact; and mounting means mounting said first insertion member for movement relative said second insertion member to provide alignment of said first and second ends and simultaneous complete insertion of the conductor into the strain relief member and into said insulation piercing portion of the electrical contact.

42. The insertion mechanism of claim 41, comprising:

cutting means, including means cooperable with said second member, for cutting the conductor during the insertion operation at a point adjacent the insulation piercing portion, said forward end of said first member extending beyond said forward end of said second member a predetermined distance to insure initiation of insertion into the strain relief member prior to cutting of the conductor.

43. An insertion mechanism for pressing an insulated conductor into an insulation piercing portion of an electrical contact which has a conductor receiving strain relief member adjacent thereto, said mechanism comprising:

a first insertion member including a forward end and a rear end, said forward end adapted to engage the conductor opposite the strain relief member upon forward movement of said first insertion member;

a second insertion member slidably carrying and mutually movable with said first insertion member, said second insertion member including a forward end adapted to engage the conductor adjacent the engagement thereof by said first insertion member, a surface facing said rear end of said first insertion member, and means for receiving forces to move said second insertion member in the forward and rearward directions; and biasing means between said rear end of said first insertion member and said surface of said second insertion member normally urging said forward end of said first insertion member toward a position forward of said forward end of said second insertion member to provide a partial insertion of the conductor into the strain relief member as said first and second insertion members move toward the electrical contact to initiate insertion and yieldable to permit alignment of said first ends for simultaneous complete insertion into the strain relief member and into the insulation piercing portion of the electrical contact as said insertion members move farther toward the electrical contact.

44. An insertion mechanism according to claim 43, wherein said second insertion member includes a shoulder for engagement by said rear end of said first insertion member when said forward ends are aligned.

45. An insertion mechanism for pressing an insulated conductor into a gripping portion of an electrical contact, comprising:

an insertion tool for engaging the conductor;

an insertion lever carrying said insertion tool and adapted to receive an operating force; and pivotal mounting means for said insertion lever providing a pivoting axis for said insertion lever, said pivotal mounting means including adjusting means for adjusting the mounted position of said insertion lever with respect to its pivoting axis to define a selected limit of insertion movement of said insertion tool.

46. An insertion mechanism for pressing an insulated conductor into a conductor gripping portion of an electrical contact, comprising:

an insertion tool for engaging the conductor;

a first pivotally mounted arm carrying said insertion tool;

a second pivotally mounted arm adapted to receive an operating force; and a compression spring coupling said first and second arms to transfer the force into an insertion force.

47. An insertion mechanism according to claim 46, wherein said first and second arms are pivotally mounted for rotation about the same axis.

48. An insertion mechanism according to claim 46, comprising:

a cam follower carried on said second arm; and a rotatable cam for providing the operating force to said cam follower portion.

49. An insertion mechanism for pressing a pair of insulated conductors into the insulation-piercing portions of respective electrical contacts, comprising:

a pair of insertion tools for engaging respective ones of the conductors;

a pair of pivotally mounted first arms, each of said first arms carrying a respective insertion tool;

a pair of second arms each of which is associated with and pivotally mounted for rotation about the same axis as a respective first arm;

a pair of cam followers each of said cam followers on respective second arms;

a rotatable cam including a pair of diametrically opposite cam lobes for imparting an operating force simultaneously to each of said cam followers;

a pair of compression springs, each of said springs coupling as associated first and second arms to transfer the operating force into an insertion force; and biasing means urging said cam followers toward said cam.

50. An insertion mechanism according to claim 49, wherein each of said cam followers comprises a roller mounted on a respective second arm.

51. An insertion mechanism according to claim 49, wherein said biasing means comprises a spring connected to said pair of second arms.

52. An insertion mechanism according to claim 49, wherein each of said second arms includes a recess for receiving an end of the respective compression spring.

53. An insertion mechanism according to claim 49, wherein each of said second arms includes a portion having a slot for receiving a portion of the respective first arm, the axis of rotation extending through said portions.

54. A conductor terminating mechanism for terminating a plurality of insulated conductors in respective terminating portions of respective spaced apart electrical contacts which are supported in alignment by an electrical device, comprising:

device support means for supporting the electrical device;

conductor support means for supporting a plurality of insulated conductors;

a carriage mounted for movement relative said device support means in the direction of alignment of the electrical contacts between points spaced a distance of at least the spacing between the terminating portions of the electrical contacts;

an insertion mechanism mounted on said carriage for movement toward and away from the electrical device and including at least one insertion tool for engaging and pressing a conductor into the terminating portion of the electrical contact;

first switch means operated by said insertion mechanism upon movement thereof away from the electrical device;

a conductor guide means mounted on said carriage for receiving accurately positioning a conductor for insertion;

insertion control means including second switch means operated by an accurately positioned conductor to effect movement of the insertion tool; and an insertion programmer connected to said first switch means and operable to effect movement of said carriage to the spaced points in response to operation of said first switch means.

55. In an apparatus for terminating an electrical conductor in a terminating portion of an electrical contact which is supported in the path of travel of a terminating tool, the improvement comprising a conductor guide for receiving a conductor as the same is moved under tension generally toward the contact, including a first guide member comprising a first arcuate edge directed toward the path for engaging and guiding a first portion of the conductor, and a second guide member comprising a second arcuate edge extending in a plane which intersects the plane of said first arcuate edge and directed toward the path for engaging and guiding a second portion of the conductor, said first and second edges cooperable to accurately position the moving conductor between the terminating portion of the contact and the terminating tool.

56. The improvement of claim 55, wherein said first and second guide members are mounted perpendicularly to each other and said first and second arcuate edges are circular and tangent to the path of travel of the terminating tool.

57. In an apparatus for electrically terminating an electrical conductor in a terminating portion of an electrical contact which is supported in the path of travel of a terminating tool, the improvement comprising a conductor guide for receiving a conductor as the same is moved generally toward the contact, including conductor funneling means for directing the conductor toward the contact, and conductor alignment means cooperable with said conductor funneling means for aligning the conductor adjacent the terminating portion of the contact in the path of travel of the terminating tool, said conductor funneling means comprising a plurality of members directed to converge toward said conductor alignment means, said plurality of members including a first member for slidably engaging and directing a first portion of the conductor toward the terminating portion at a first rate, and a second member extending to said alignment means for slidably engaging and directing a second portion of the conductor toward the terminating portion at a second rate, which is slower than said first rate, and permitting the conductor to accelerate upon reaching said alignment means.

58. The improvement according to claim 57, wherein said conductor alignment means comprises a pair of walls extending along opposite sides of at least a portion of the path of travel of the termination tool.

59. An insertion mechanism for pressing an insulated conductor into an insulation piercing portion of an electrical contact which has a conductor receiving strain relief member adjacent thereto, said mechansim comprising:

a movably mounted first insertion member having a forward end for engaging the conductor opposite the strain relief member;

a movably mounted second insertion member adjacent said first insertion member and having a forward end for engaging the conductor opposite the insulation piercing portion of the electrical contact; and means for moving said first and second insertion members such that said first insertion member presses said conductor at least partially into said strain relief member before said second insertion member presses said conductor into said insulation piercing portion of said electrical contact.

60. An insertion mechanism for pressing an insulated conductor into a terminating portion of an electrical contact device, a conductor holding device located adjacent the terminating portion, said mechansim comprising:

a movably mounted first insertion member associated with the conductor holding member and having a forward end for engaging the conductor opposite the conductor holding member;

a movably mounted second insertion member associated with the terminating portion of the electrical contact and having a forward end for engaging the conductor opposite the portion; and means for moving said first and second insertion members such that one of said insertion members presses the conductor at least partially into its associated device before the other of said insertion members presses the conductor into its associated device.

* * * * *